US006491074B1

(12) United States Patent
Roegner

(10) Patent No.: US 6,491,074 B1
(45) Date of Patent: Dec. 10, 2002

(54) PURSE FOR CARRYING VARIOUS ARTICLES

(76) Inventor: DeAnna Roegner, 774 Mays Blvd. #10-405, Incline Village, NV (US) 89451-9813

( * ) Notice: Subject to any disclaimer, the term of this patent is extended or adjusted under 35 U.S.C. 154(b) by 0 days.

(21) Appl. No.: 09/666,777

(22) Filed: Sep. 21, 2000

Related U.S. Application Data

(63) Continuation-in-part of application No. 09/229,241, filed on Jan. 12, 1999, now Pat. No. 6,095,213, which is a continuation-in-part of application No. 08/886,719, filed on Jul. 1, 1997, now Pat. No. 5,865,233.

(51) Int. Cl.[7] ..... A45C 3/06
(52) U.S. Cl. ..... 150/112; 190/110
(58) Field of Search ..... 150/112, 113, 150/114, 115–117, 132, 131, 148, 178; 190/110, 112, 113, 108, 109

(56) References Cited

U.S. PATENT DOCUMENTS 3,874,435 A * 4/1975 Allen ..... 150/1.6
4,171,011 A * 10/1979 Kopin ..... 150/34
4,192,365 A * 3/1980 Siegel ..... 150/35
4,250,938 A * 2/1981 Siegel ..... 150/35
4,569,082 A * 2/1986 Ainsworth et al. ..... 383/3
4,609,084 A * 9/1986 Thomas ..... 190/110
4,739,809 A * 4/1988 Adams ..... 150/112
4,754,790 A * 7/1988 Meyers ..... 150/104
4,805,749 A * 2/1989 Gerch ..... 190/111
5,159,999 A * 11/1992 Voigt ..... 190/111
5,288,150 A * 2/1994 Bearman ..... 383/38
5,445,199 A * 8/1995 Jia ..... 150/136
5,911,262 A * 6/1999 Steihart ..... 150/103
6,000,509 A * 12/1999 Chisholm ..... 190/109
6,047,752 A * 4/2000 Shouthwick ..... 150/117
6,216,297 B1 * 4/2001 Lemket ..... 5/636

* cited by examiner

*Primary Examiner*—Lee Young
*Assistant Examiner*—Lien Ngo
(74) *Attorney, Agent, or Firm*—Freling Baker

(57) ABSTRACT

A purse for carrying and organizing various articles with compartments, panels, pockets and flaps shaped, sized, located and connected to each other in a manner that allows superior securement of and access to articles of certain shapes (such as drinking bottles, umbrellas, eyeglasses, credit cards and so on), while also including segregated storage spaces to allow additional storage of all kinds of other articles. The purse of the present invention may be implemented as an organizing insert that can be switched between a variety of outer shells, as fashion, weather conditions and whim dictate.

16 Claims, 9 Drawing Sheets

PURSE FOR CARRYING VARIOUS ARTICLES

REFERENCE TO RELATED APPLICATIONS

This is a continuation-in-part of application Ser. No. 09/229,241, now U.S. Pat. No. 6,095,213, filed Jan. 12, 1999, entitled PURSE ORGANIZER AND CARRYING CASE, which application was a continuation-in-part of application Ser. No. 08/886,719, filed Jul. 1, 1997, entitled PURSE ORGANIZER now U.S. Pat. No. 5,865,233.

BACKGROUND OF THE INVENTION

I. Field of the Invention

The present invention relates to purses, and pertains more particularly to an improved organizing purse having an improved arrangement of pockets and panels for holding various kinds of personal articles in an organized fashion.

II. The Background Art

People use purses to carry personal articles and effects. Some purses have a very simple construction. For example, some conventional purses consist merely of an outer shell that defines a single storage space compartment and a handle (e.g. shoulder straps).

Some purses, however, do have features that facilitate organization and more secure storage of the articles contained therein. Conventionally, these purses have different arrangements of pockets, compartments, closures and the like to segregate, and thereby organize, articles within the purse, and to better secure articles in the purse by providing multiple segregated spaces within the purse where various articles can be placed in separate groups.

Various small pots of make-up, wallets, small mirrors, combs, pocket knifes, coins, sewing kits, toiletries, credit cards, identification cards, papers bearing notes, writing instruments, check books, keys, combs, small food items (e.g., gum) and small books (e.g. paperback books) serve to illustrate the wide variety of articles that may be found in a purse. Although some purses have more than one compartment or pocket to help organize and secure these wide variety of items, a motley mixture of articles is still conventionally placed loosely in the purse or among a few compartments of the purse. This limits the level of organization and security of the articles, and may leave articles tangled, disorganized or difficult to locate within the purse.

The problem of organization was partly solved in my prior parent applications, which disclosed a purse organizer that solved many of the problems of the prior art. However, I have discovered the need for additional improvements. One improvement disclosed in my prior patent applications is the provision for converting the organizer to an appealing clutch—a small strapless handbag—or shoulder bag for convenient carrying of items separate from other personal articles. Another improvement disclosed in my prior patent applications is a modification to provide a zipper closure around the periphery of the purse organizer.

Now that the previous generations of improvements have been disclosed to the public, I know of no publicly-recognized problems, complaints, suggestions for improvement or the like relating to purses. To the extent that I have discovered shortcomings of currently-available purse products, such discoveries will be addressed below in the Summary of the Invention section, because such discoveries are not prior art, and are therefore inappropriate for discussion in this Background section.

SUMMARY AND OBJECTS OF THE INVENTION

There exists a need for a bag that can mount or hold many different related or unrelated personal articles in a more organized fashion. It would be desirable to have a purse organizer with multiple holding or mounting panels and pockets for holding many different related articles and/or unrelated articles for ease of location and retrieval. There is an ongoing need for a purse that can be quickly converted into a separate vanity bag or clutch.

Furthermore, there is a need for a purse organizer insert that can be selectively used in different kinds of bags, such as a purse organizer insert that can be transferred between purses of different materials or of different colors that can also be transferred to non-purse bags, such as backpacks.

One object of the present invention is to solve the problem of keeping personal articles of different sizes and shapes organized and secure. Another object of the present invention is to provide a purse organizer insert that can be selectively transferred between purse-style bags and various non-purse-style bags (eg, backpacks).

Broadly, the invention provides an organizing purse with multiple pockets and attachment means for holding articles of different sizes secure and readily accessible in an organized arrangement. At least some embodiments of purse organizer inserts according to the present invention can be carried in a purse, a non-purse-style bag (eg backpack), or carried alone as a clutch, or as a small shoulder bag.

More specifically, the following aspects of the present invention may be implemented as an organizing purse: an outer shell structured to define an interior space; an organizing insert detachably mounted to the outer shell at least substantially within the interior space, the organizing insert comprising: an insert front panel made of pliable material; an insert back panel made of pliable material; at least one insert intermediate panel made of pliable material, with the insert front panel, the insert back panel and the at least one insert intermediate panel being structured and located to define at least two organizing compartments; a first multi-card pocket assembly made of pliable material, with the first multi-card pocket assembly comprising a plurality of pockets shaped and sized to secure credit-card-sized objects; a second multi-card pocket assembly made of pliable material, with the first multi-card pocket assembly comprising a plurality of pockets shaped and sized to secure credit-card-sized objects, with the second multi-card pocket assembly being pivotable between a first position adjacent to the first multi-card pocket assembly and a second position spaced away from first multi-card pocket assembly; and a window panel with a window defined therein, with the window panel being connected to the outer shell at a location so that the window is aligned with and thereby exposes at least one of the first multi-card pocket assembly and the second multi-card pocket assembly. Another aspect of the present invention may be implemented as purse comprising: an outer shell made of pliable material, with the outer shell defining an interior space; at least one inner shell made of pliable material and located to define a main compartment within the interior space and to define a main compartment opening on the outer shell; and at least one elongated-object-holder shell made of pliable material and located to define an elongated-object-holder compartment shaped to hold elongated objects within the interior space and to define an elongated-object-holder opening on the outer shell.

Another aspect of the present invention may be implemented as a purse comprising: an outer shell made of pliable material, the outer shell defining an interior space; a generally planar rigid panel located within the interior space, with the rigid panel having an aperture defined therein; and at least one pocket made of pliable material, with the at least one pocket defining a pocket opening, and with the pocket being located so that the pocket opening is aligned with the aperture.

Another aspect of the present invention may be implemented as a combination of bags and an organizer insert comprising: an organizer insert; a first bag adapted to accommodate the organizer insert; and a second bag adapted to accommodate the organizer insert, with the first bag having a different size and shape than the second bag.

However, the claims alone—not the preceding summary—define the invention.

BRIEF DESCRIPTION OF THE DRAWINGS

The nature, goals, and advantages of the invention will become more apparent to those skilled in the art after considering the following detailed description when read in connection with the accompanying drawings—illustrating by way of examples the principles of the invention in which like reference numerals identify like elements throughout, wherein.

DETAILED DESCRIPTION OF THE PREFERRED EMBODIMENTS

Figure 1:
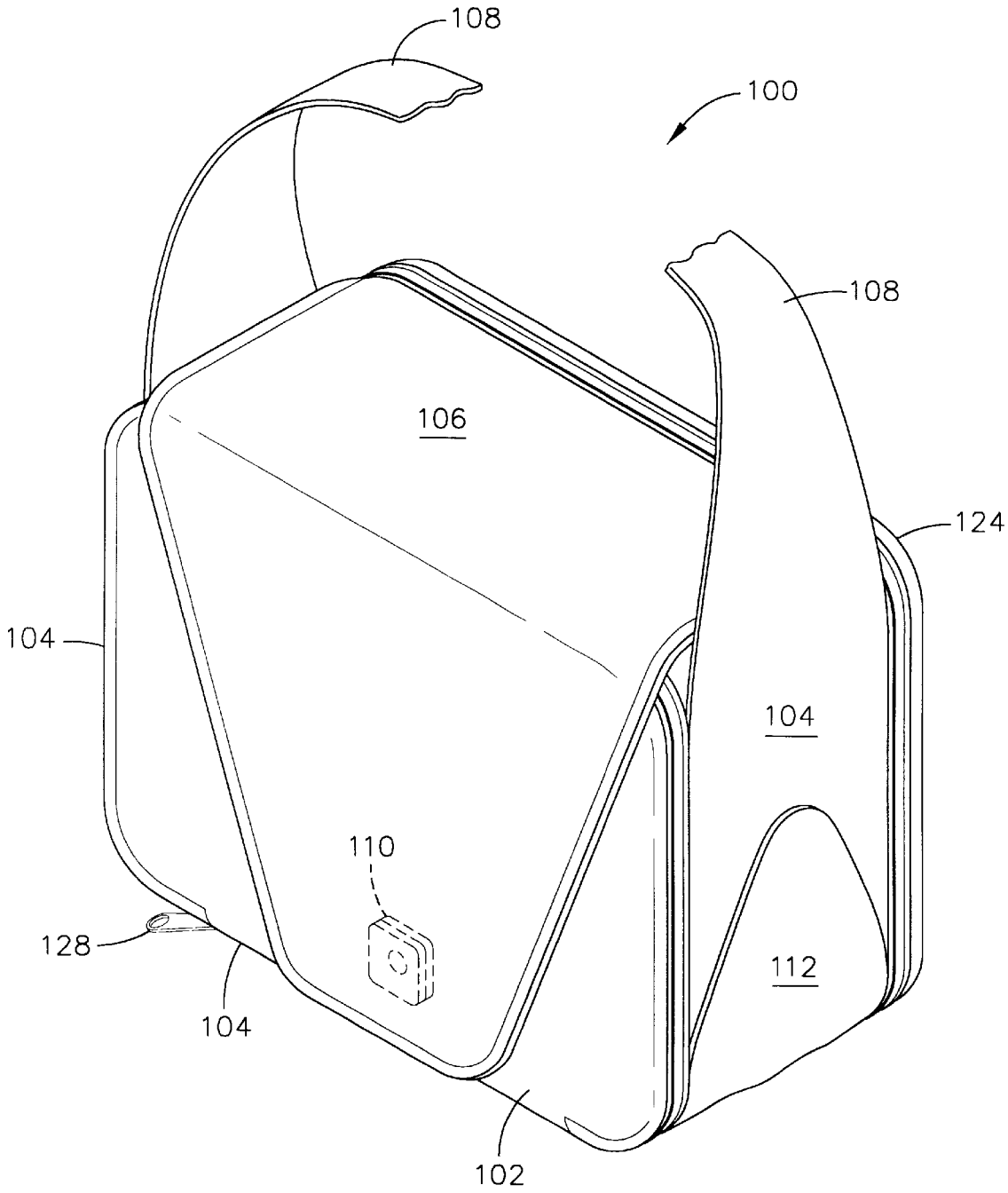
FIG. 1 is a perspective view of a purse according to the present invention, wherein the purse is closed.
Figure 2:
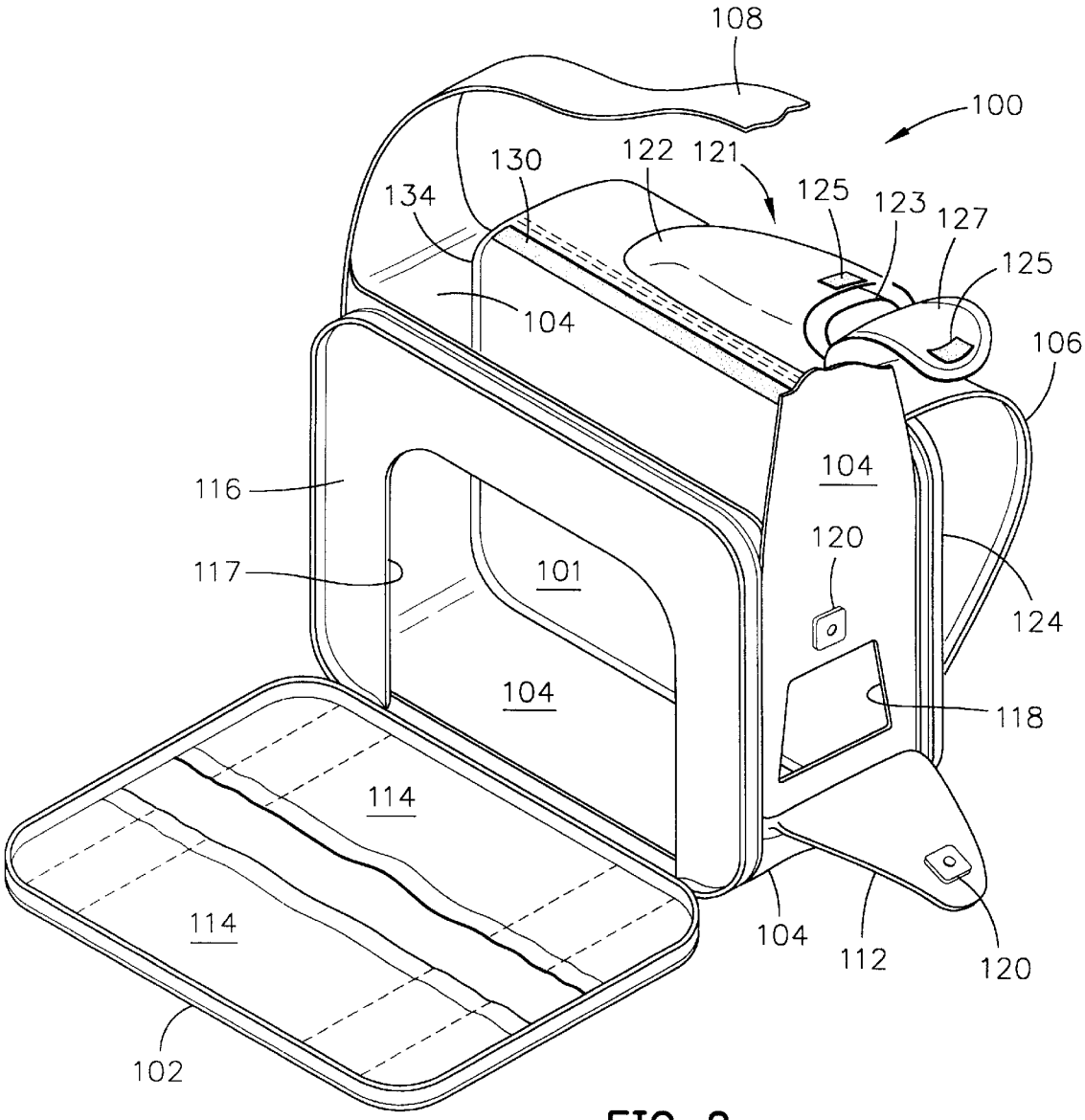
FIG. 2 is a view like FIG. 1 with the purse closure flap open.
Figure 3:
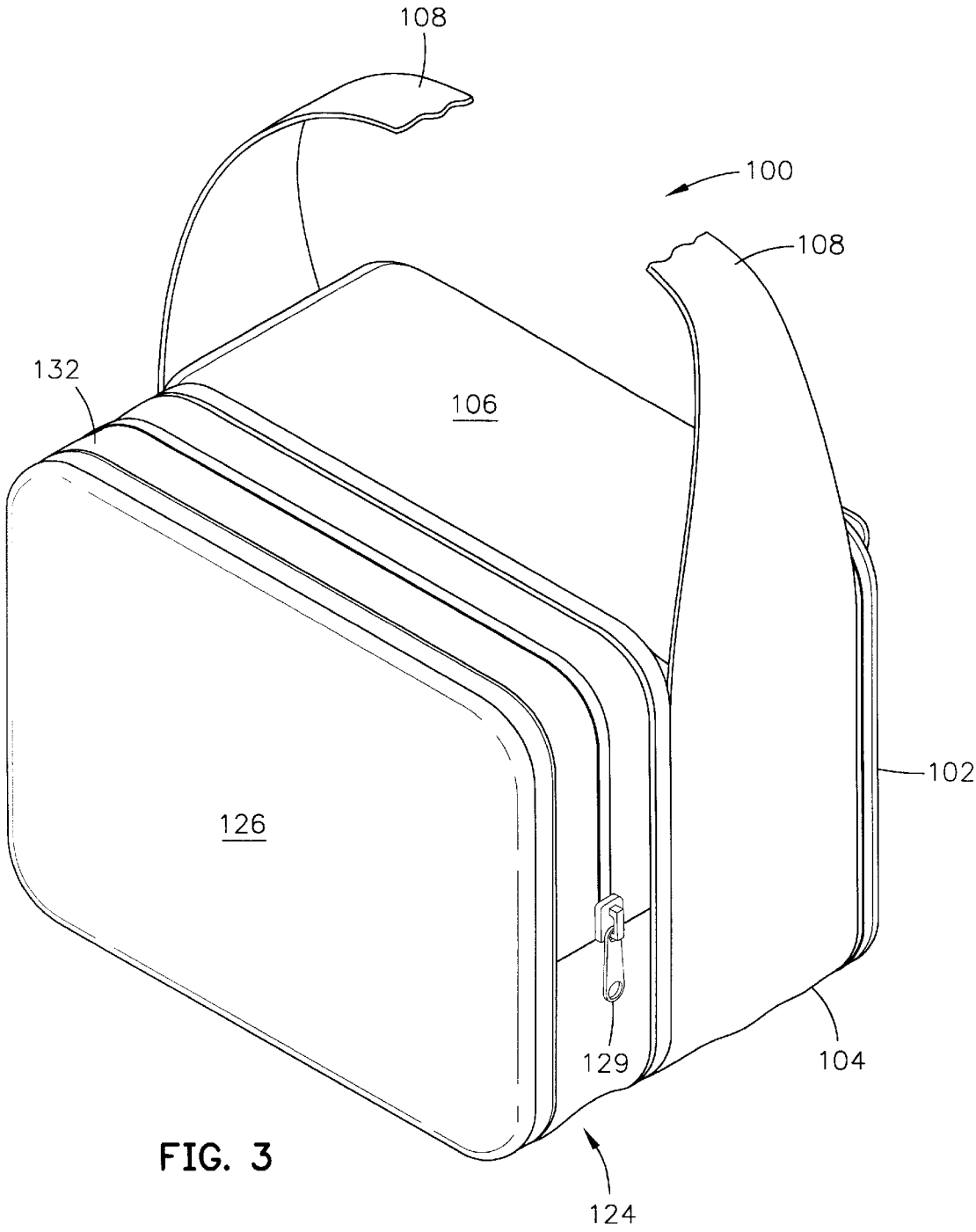
FIG. 3 is another perspective view of the purse of FIG. 1.

FIGS. 1, 2 and 3 show a preferred embodiment of purse 100 that is suitable for use with the present invention. Purse 100 includes main compartment 101, front panel 102, peripheral panels 104, closure flap 106, strap 108, first closure 110, elongated-object-compartment flap 112, opposing pockets 114, rigid panel 116, window 117, elongated-object-compartment aperture 118, second closure latch 120, eyeglasses pouch 121, eyeglasses pouch shell 122, eyeglasses pouch divider panel 123, expandable compartment 124, third closure 125, ba eyeglasses pouch flap 127, front panel zipper 128, spiral zipper 129, first attachment strip 130, expandable side wall 132, and expandable compartment front panel 134.

Purse 100 is an outer shell preferably made mostly of pliable material (eg, cloth, leather, vinyl, suede), with the principle exception of rigid panel 116. As shown in FIGS. 1 to 3, main compartment 101 is defined primarily by front panel 102, peripheral panels 104, closure flap 106, rigid panel 116 and expandable compartment 124. As explained below, main compartment 101 is sized and shaped to accommodate purse organizer insert 200 (not shown in FIGS. 1 to 3). The panels are secured together along their peripheral edges to form the shell and receptacle as shown.

Purse 100 can be selectively manipulated between a closed position (shown in FIG. 1) and an open position (shown in FIG. 2) as follows: (1) opening first closure 110 to release closure flap 106 from front panel 102; and (2) opening front panel 102 by unzipping front panel zipper 128. First closure 110 is preferably formed as a conventional magnetic clasp.

Strap 108 serves as a handle that allows the purse to be more easily carried by hand or over the shoulder in the manner of a conventional purse.

Elongated-object-compartment flap 112 (shown in FIGS. 1 and 2) can be manipulated between a closed position (shown in FIG. 1) and an open position (shown in FIG. 2) as follows: (1) undoing second closure 120; and (2) rotating elongated-object compartment flap 112 down away from peripheral panel 104. Second closure latch 120 is preferably formed as a conventional magnetic clasp. Elongated-object compartment flap 112 serves to selectively allow access to an elongated-object compartment (not shown in FIGS. 1 to 3) through elongated-object aperture 118, as further explained below.

Opposing pockets 114 are preferably sewn into an interior face of front panel 102. Opposing pockets 114 serve to secure and segregate small articles (not shown), which in turn provides for better organization of small articles. Alternatively, front panel 102 may be provided without pockets, or with pockets arranged, oriented and sized in lots of different ways.

Rigid panel 116 includes window 117. As used herein, the word "rigid" is used to mean any material that is rigid enough not to be considered pliable. As an example, cloth is pliable, while a sheet of cardboard or the sole of a shoe is "rigid" (as that term is used herein). Rigid panel 116 serves to help secure purse organizer insert 200 (not shown in FIGS. 1 to 3 and further explained below), while window 117 allows easier access to purse organizer insert 200 when purse organizer insert 200 is secured within main compartment 101.

Eyeglasses pouch 121 is shaped and sized to secure two pairs of eyeglasses (not shown). Eyeglasses pouch includes eyeglasses pouch shell 122, eyeglasses pouch divider panel 123, third closure 125, and eyeglasses pouch flap 127. Eyeglasses pouch shell 122 serves to define a compartment for holding the two pairs of eyeglasses. In the embodiment shown in FIG. 2, eyeglasses pouch shell 122 is made of pliable material. Alternatively, eyeglasses pouch shell 122 can be made of rigid material in order to provide more protection for the eyeglasses stored therein.

Eyeglasses pouch divider panel 123 serves to segregate the two pairs of eyeglasses that can be stored in eyeglasses pouch 121, to thereby help prevent the two pairs of eyeglasses from scratching each other. Alternatively, no eyeglasses pouch divider panel may be provided, which is preferable in alternative embodiments wherein eyeglasses pouch 121 is sized and shaped to hold only a single pair of eyeglasses. As a further alternative, additional eyeglasses pouch divider panels can be provided so that eyeglasses pouch 121 can hold more than two pairs of eyeglasses.

Eyeglasses pouch 121 can be opened and closed by selectively closing and releasing third closure 125 and by manipulating eyeglasses pouch flap 127. Third closure 125 is preferably formed as a hook-and-loop (eg, Velcro (trademark)) fastener.

As shown in FIG. 3, expandable compartment 124 includes back panel 126, spiral zipper 129, expandable side wall 132, and expandable compartment front panel 134.

Expandable compartment 124 is defined by back panel 126, expandable side wall 132 and expandable compartment front panel 134. Expandable compartment 124 can be manipulated between an expanded position and a contracted position by selectively zipping and unzipping spiral zipper 129 to thereby expand and contract expandable side wall 132. Expandable side wall 132 is preferably made of pliable material to facilitate its expansion and contraction.

Expandable compartment 124 serves to segregate articles secured therein from articles stored in main compartment 101. In the expanded position, expandable compartment 124 can hold larger objects (eg, a blouse) or a large quantity of small articles. In the contracted position, the volume of purse 100 is rendered considerably smaller so that purse 100 is less bulky. The outer shell may also convert into a back pack by use of strap 108 as a shoulder strap.

First attachment strip 130 serves to secure purse organizer insert 200 (not shown in FIGS. 1 to 3 and further explained below) in main compartment 101. This attachment strip is preferably formed as a strip of hook-and-loop material, and preferably located along the top edge of expandable compartment front panel 134, as shown in FIG. 2. The first attachment strip 130 can alternatively be located elsewhere on the interior surfaces of main compartment 101. Also, additional attachment strips and/or patches can be provided on the interior surfaces of main compartment 101.

Figure 5:
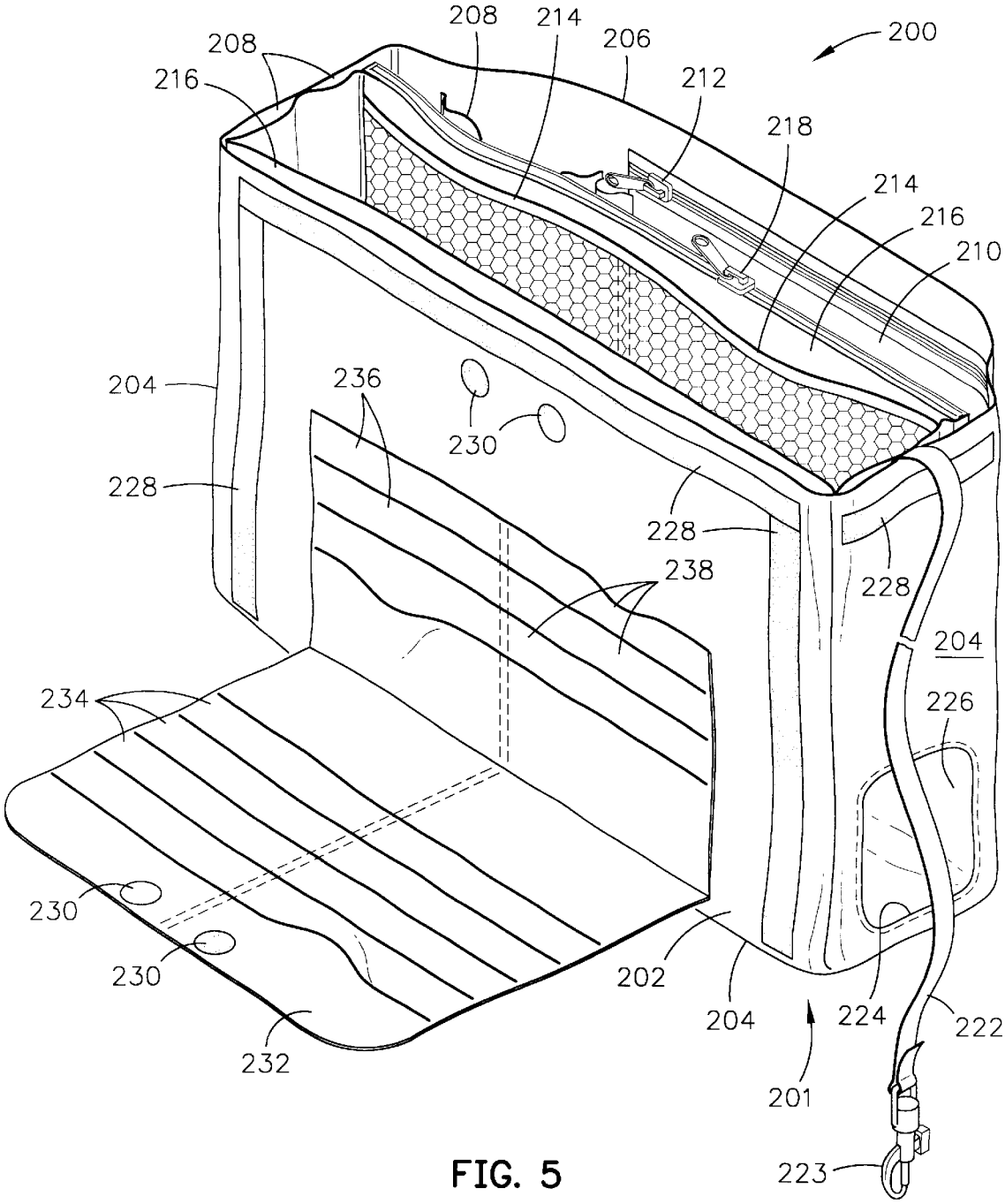
FIG. 5 is another perspective view of the purse organizer insert of FIG. 4.
Figure 6:
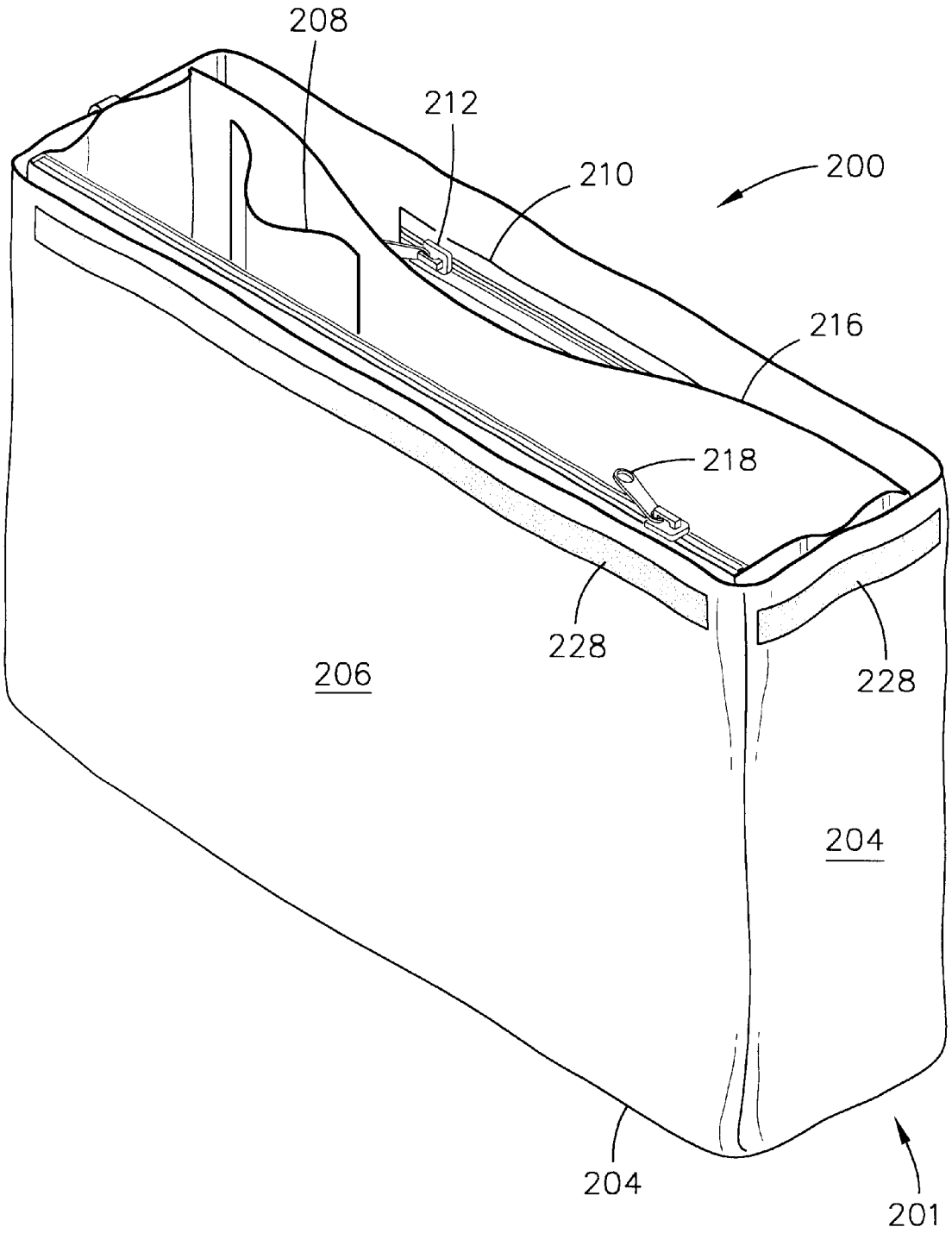
FIG. 6 is another perspective view of the purse organizer insert of FIG. 4.

Now purse organizer insert 200 will be discussed with reference to FIGS. 4 to 6. Purse organizer insert 200 includes outer shell 201, front panel 202, peripheral panels 204, back panel 206, vertical pockets 208, zippered pockets 210, zippers 212, mesh pockets 214, divider panels 216, zipper 218, suspension strap 222, suspension closure 223, elongated-object-compartment aperture 224, elongated-object compartment 226, attachment strips 228, fourth closure 230, first pocket panel 232, first credit-card pockets 234, second pocket panel 236, and second credit-card pockets 238.

Purse organizer insert 200 is preferably made primarily of pliable material. Outer shell 201 is primarily defined by front panel 202, peripheral panels 204 and back panel 206. The top of purse organizer insert 200 is left open to expose a plurality of pockets and dividers disposed therein. The pockets and dividers facilitate segregation and organization of small articles. In this way, when purse organizer insert 200 is used alone as a "clutch," small articles can be better organized by being selectively segregated by the various pockets and dividers. Also, when purse organizer insert 200 is placed within main compartment 101 of purse 100 (as further explained below in connection with FIG. 7), it likewise facilitates better organization and segregation of articles in the purse.

Divider panels 216 divides purse organizer insert 200 lengthwise into several compartments. The number and orientation of divider panels can be varied depending on the preferred size, number and orientation of the compartments. As shown in FIG. 5, adjacent divider panels 216 can be provided with zipper 218 in order to allow the tops of selected compartments to be closable by manipulation of the zipper.

Vertical pockets 208 can be selectively placed along one or more of front panel 204, peripheral panels 204, back panel 206 and divider panels 216. Alternatively, zippered pockets 210 may also be provided with zippers 212 in order to allow selected pockets to more securely retain articles stored therein. Alternatively, mesh pockets 214 may be provided in order to provide better visibility of articles stored in mesh pockets 214. The combination of pockets and dividers of purse organizer insert 200 is primarily intended to be exemplary, as a perhaps infinite number of combinations of dividers and pockets can be implemented within purse organizer insert 200. For example, special pockets for cell phones and pagers could be provided.

Suspension strap 222 allows purse organizer insert 200 to be suspended from a hook (eg a hook mounted on the wall of a closet) by suspension closure 223. Alternatively, suspension strap 222 and closure 223 can be utilized as a metal clip with a key ring on a leash.

Elongated-object compartment aperture 224 in peripheral panel 204 allows free access to elongated-object compartment 226. Elongated-object compartment 226 is a pocket that extends across the length of purse organizer insert 200 along the bottom peripheral panel 204, and is therefore much deeper than it is wide. Preferably, elongated-object compartment 226 is from about five to about eight times deep as it is wide. This facilitates storage of elongated articles (not shown), such as umbrellas, drinking bottles and rulers. Conventionally, it is difficult to store elongated objects in a purse because conventional purses do not have elongated, lengthwise pockets that open on a peripheral side. The present invention solves that problem by the provision of elongated-object compartment 226.

The interior faces of elongated-object compartment 226 can be made to be waterproof in order to prevent the spread of liquid from wet umbrellas, drinking bottles or the like.

Attachment strips 228 are located at intervals on outer shell 201 in order to selectively and detachably attach the purse organizer insert to purse 100, backpack 400, or other bags equipped with mating attachment strips (as further explained below in connection with FIGS. 7 and 9). Attachment strips 228 are preferably formed of hook-and-loop fastener fabric.

First pocket panel 232 includes a plurality of first credit-card pockets 234, preferably distributed on both of its main faces. First credit-card pockets 234 are sized and shaped to secure credit-card sized objects such as credit cards and identification cards, while allowing partial visibility of the cards (not shown) stored therein.

Figure 4:
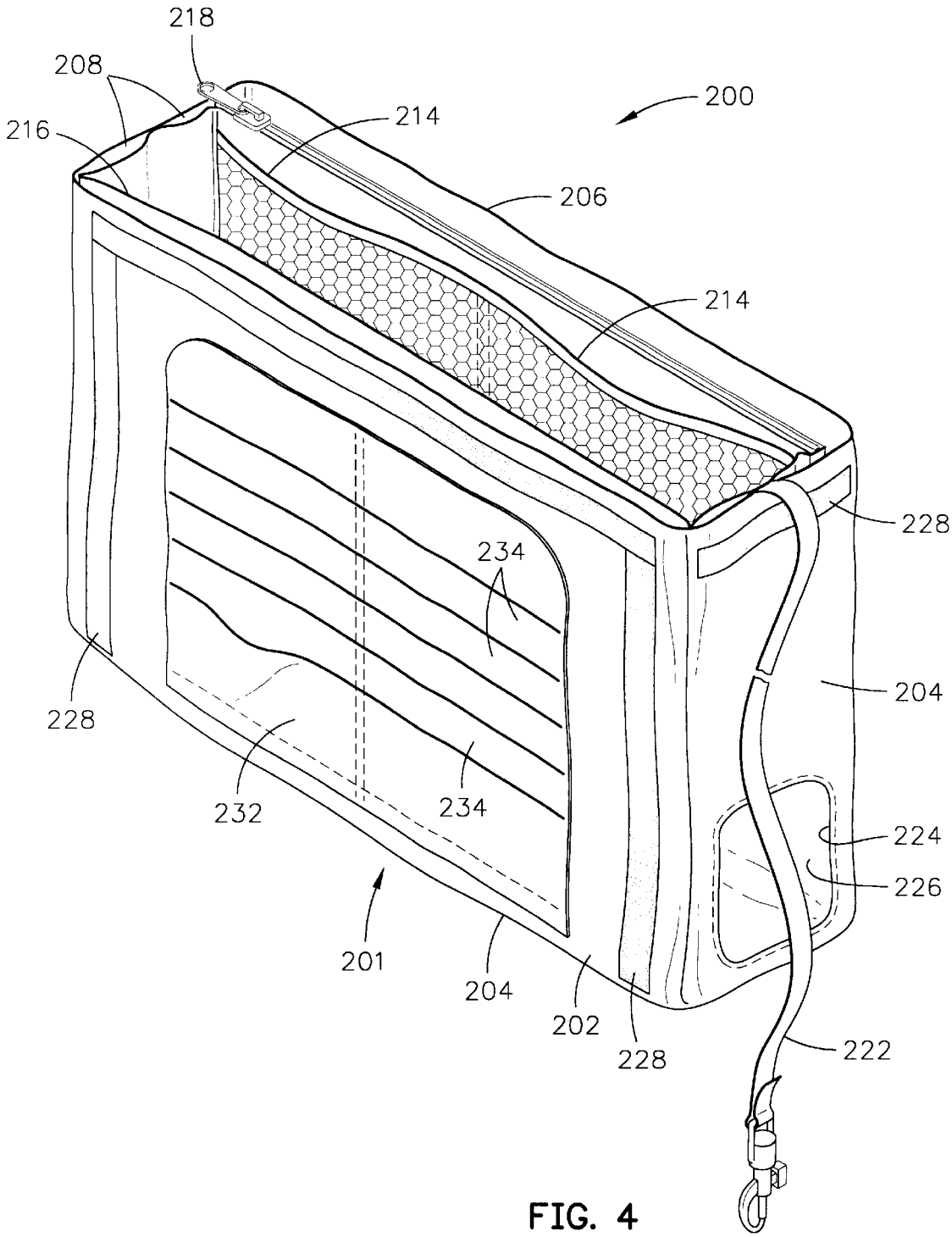
FIG. 4 is a perspective view of a purse organizer insert according to the present invention.

First pocket panel 232 can be manipulated between a closed position (as shown in FIG. 4) and an open position (shown in FIG. 5) as follows: (1) selectively closing and releasing fourth closure 230; and (2) selectively rotating first pocket panel towards and away from front panel 202. Fourth closure 230 is preferably made of hook-and-loop fastener material. In the closed position, the first credit-card pockets 234 on the outer main face of first pocket panel 232 are exposed. In the open position, first credit-card pockets 234 on the inner main face of first pocket panel 232 are exposed.

When first pocket panel 232 is in the open position, second pocket panel 236 and second credit-card pockets 238 are also exposed. Second credit-card pockets are sized and shaped to secure credit-card sized objects such as credit cards and identification cards, while allowing partial visibility of the cards (not shown) stored therein. This kind of arrangement of first pocket panel 232 and second pocket panel 236 permits a lot of credit cards to be stored in a small space, while still permitting good visibility of and access to each card (not shown) stored therein. Alternatively, pockets of other sizes and orientations can be substituted for first credit-card pockets 234 and second credit-card pockets to facilitate storage of different kinds of articles. For example, a checkbook pocket shaped and sized to hold a standard checkbook could be provided.

Figure 7:
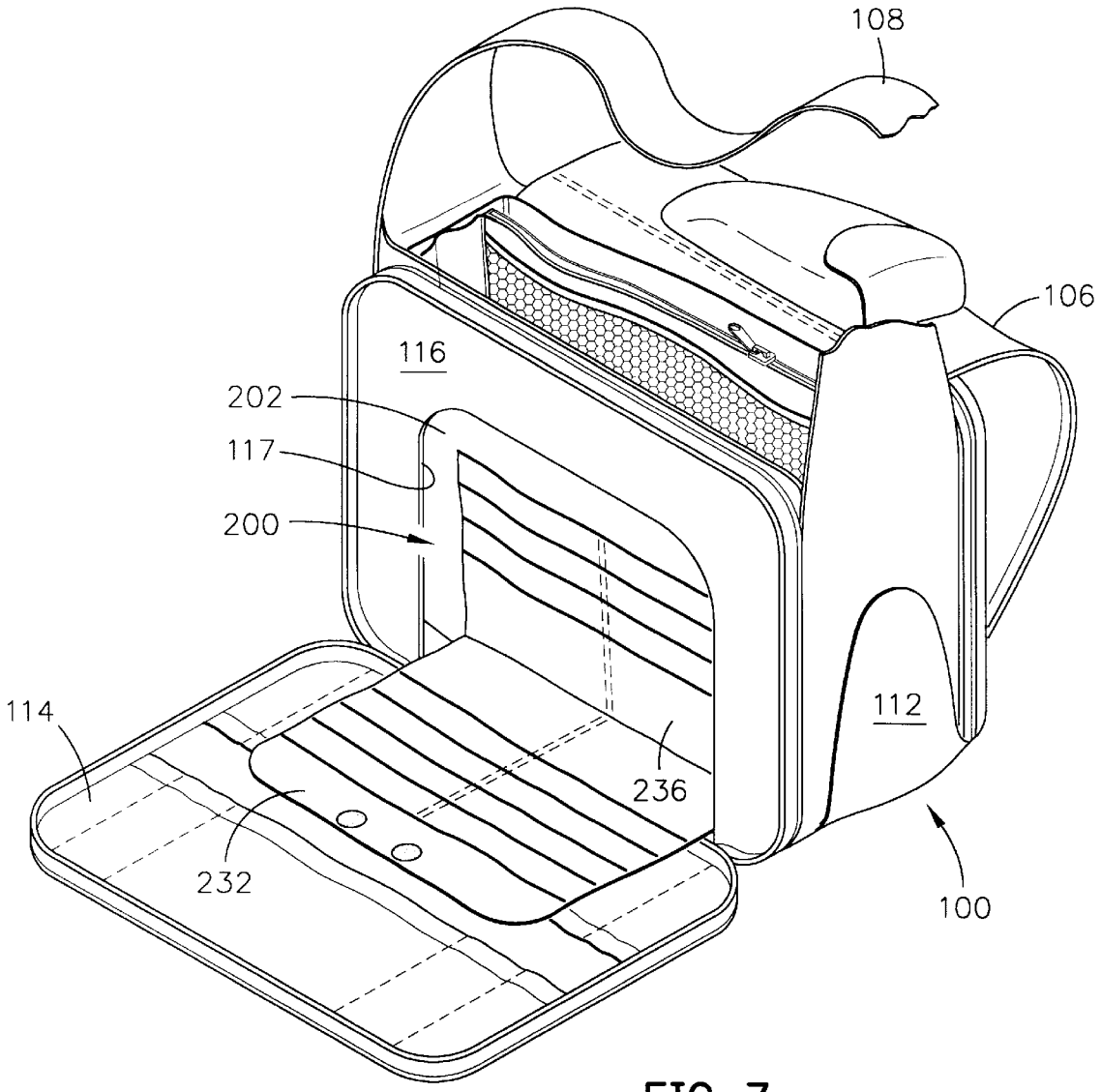
FIG. 7 is a perspective view of a combination purse and purse organizer insert according to the present invention.

FIG. 7 shows how purse insert organizer 200 can be used in combination with purse 100 in order to allow articles stored within purse 100 to be better organized and segregated. More specifically, flap 106 of purse 100 can be opened to allow purse organizer insert 200 to be placed into main compartment 101. First attachment strips 130 of purse 100 are detachably attached to attachment strips 228 of purse insert organizer 200 to better secure purse organizer insert 200 to purse 100. The attachment strips are located to be aligned when purse organizer insert 200 is in the correct position within main compartment 101 to facilitate this detachable attachment.

Alternatively, purse 100 and purse organizer insert 200 can be provided without attachment strips, such that purse organizer insert 200 is secured within purse 100 by a combination of gravitational force and friction between the purse organizer insert and the purse.

As shown in FIG. 7, when purse organizer insert 200 is placed within main compartment 101, first pocket panel 232 and second pocket panel 236 are aligned with window 117, so that the first credit-card pockets 234 and second credit-card pockets 236 can be accessed through window 117. The rigidity of rigid panel 116 helps provide support when first pocket panel 232 is opened and closed.

When purse organizer insert 200 is placed within purse 100, elongated-object-compartment flap 112, elongated-object-compartment aperture 118, elongated-object-compartment aperture 224 and elongated-object compartment 226 are aligned. In this way, elongated-object-compartment flap 112 can be opened to allow access to elongated-object compartment 226 from outside of purse 100.

When objects that are longer than the depth of elongated-object compartment 226 (ie the length of purse insert organizer 200) are inserted into elongated-object aperture 226, flap 112 may be kept in the open position in order to allow the elongated object to partially protrude from purse 100. Even when an object partially protrudes from elongated-object compartment 226 and purse 100, it will still be supported well due to the relatively great depth of elongated-object compartment 226. Also, because the object protrudes from a peripheral side of purse 100, it will tend to be less cumbersome than it would in a conventional purse, wherein the object would protrude from the top of the purse.

It is also noted that the unconventional placement of elongated-object compartment 226 allows discreet storage of objects that one may want to hide, such as a roll of valuable jewels (not shown) or a tall bottle of vodka (not shown).

It is to be noted that a single purse organizer insert 200 can be switched between purses 100 that are constructed in a wide variety of styles and colors.

Figure 8:
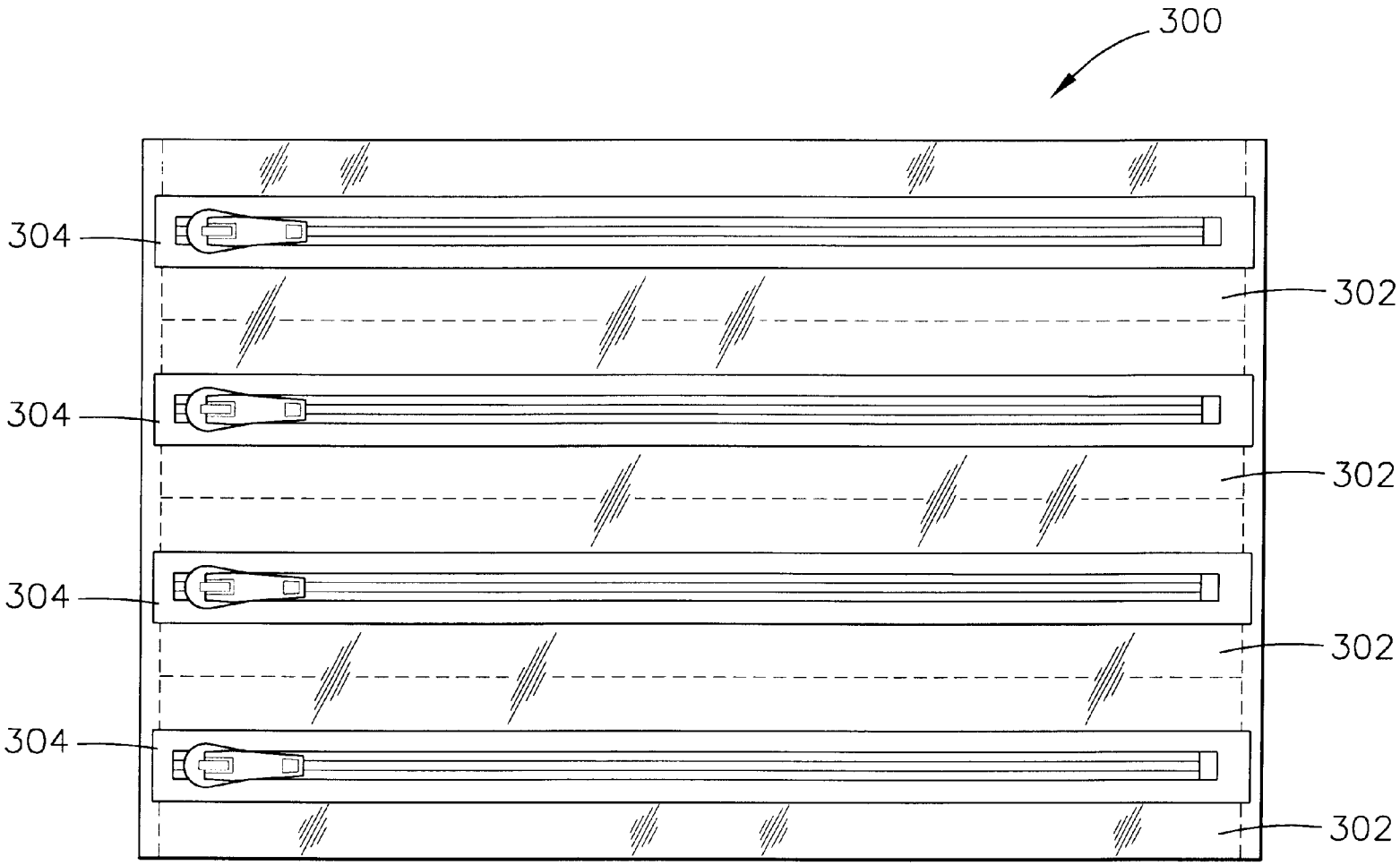
FIG. 8 is a perspective view of an alternate embodiment of a purse organizer insert according to the present invention that may be used in combination with the purse and/or the purse organizer insert of FIG. 7.

FIG. 8 shows pocketed insert 300, which includes a plurality of pockets 302 that can be selectively and respectively opened and closed by a plurality of zippers 304. Pocketed insert 300 can be placed within main compartment 101 with or without purse insert organizer 200 in order to provide further organization and segregation of articles stored within purse 100. These pouches may conveniently hold numerous articles including items of jewelry and the like. The pockets are particularly adapted to receive and hold necklaces.

Figure 9:
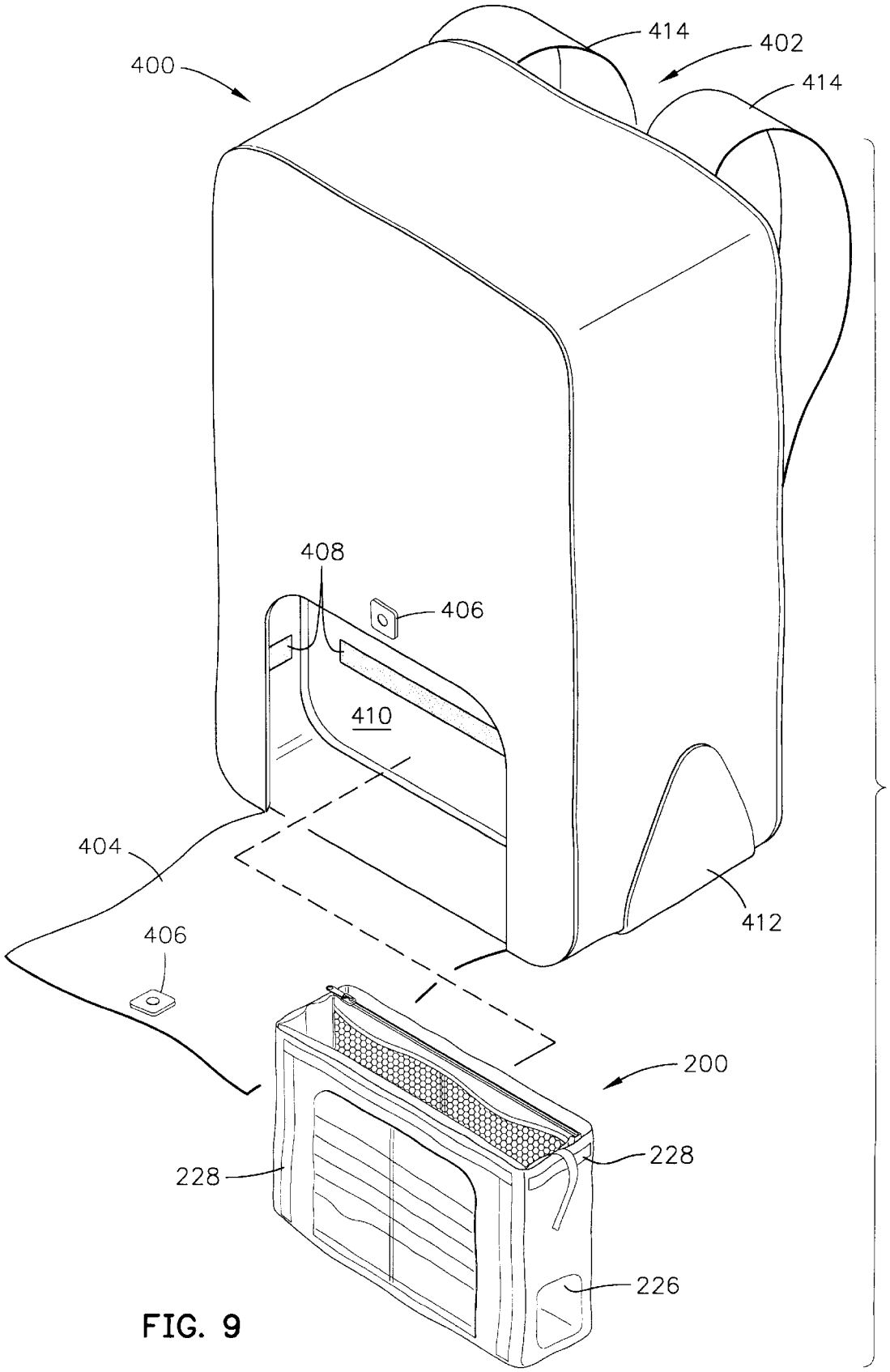
FIG. 9 is a perspective view of the purse organizer insert of FIG. 6, shown for use in a back pack configured bag.

FIG. 9 shows how purse insert organizer 200 can be used in combination with other types of specially-constructed bags, such as backpack 400. Backpack 400 includes outer shell 402, access panel 404, fifth closure 406, attachment strips 408, main compartment 410, elongated-object-compartment flap 412, and shoulder straps 414.

The purse organizer 200 can be placed within main compartment 410 as shown by arrow A. When the purse organizer 200 is placed within main compartment 410, a portion of purse organizer 200 can be accessed by manipulating closure 406 and access flap 404.

When the purse organizer 200 is in its correct position within main compartment 410, attachment strips 408 will be aligned with attachment strips 228 in order to effect detachable attachment of purse organizer 200 within main compartment 410.

Elongated-object-compartment flap 412 is similar to elongated-object-compartment flap 112 (explained above) in order to allow selective access to elongated-object compartment 226. Shoulder straps 414 are located and sized as conventional backpack straps.

Although the embodiment of FIG. 9 shows the purse organizer insert as being placed at the bottom of main compartment 410, other placements are possible by repositioning access flap 404, attachment strips 408 and elongated-object-compartment flap 412.

Alternatively, other sizes and shapes of bag can be substituted for backpack 400. As demonstrated by FIGS. 7 and 9, it is an advantage of at least some embodiments of the present invention that a single purse organizer insert 200 can be selectively switched between different types of bags. This allows quick and easy transfer of a plurality of articles (not shown) stored in purse organizer insert 200 to be transferred between different types of bags, whilst preserving the security and organization of the articles stored in the purse insert organizer.

To the extent that a patentee can act as his or her own lexicographer, the foregoing specification may in the future be scrutinized to determine whether special definitions are provided in the specification. In order to help out with any inquiries along these lines, it will now be explicitly stated that the only word for which a special definition is provided in the specification is the word "rigid." Speaking now as a lexicographer, it is hereby specified that all other words in this document should be construed according to their plain, ordinary and accustomed meaning (which can usually be determined with reference to a dictionary), rather than by altering the dictionary definitions of the words based on disclosures of the present specification.

It is appropriate that the following claims be construed broadly and in a manner consistent with the spirit and scope of the invention herein described.

What is claimed is:

1. An organizing purse, the purse comprising:

an outer shell structured to define an interior space;

an organizing insert detachably mounted to the outer shell at least substantially within the interior space, the organizing insert comprising:

an insert front panel made of pliable material;

an insert back panel made of pliable material;

at least one insert intermediate panel made of pliable material, with the insert front panel, the insert back panel and the at least one insert intermediate panel being structured and located to define at least two organizing compartments;

a first multi-card pocket assembly made of pliable material, with the first multi-card pocket assembly comprising a plurality of pockets shaped and sized to secure credit-card-sized objects;

a second multi-card pocket assembly made of pliable material, with the second multi-card pocket assembly being pivotable between a first position adjacent to the first multi-card pocket assembly and a second position spaced away from first multi-card pocket assembly; and a window panel with a window defined therein, with the window panel being connected to the outer shell at a location so that the window is aligned with and thereby exposes at least one of the first multi-card pocket assembly and the second multi-card pocket assembly.

2. The organizing purse of claim 1 wherein:

the outer shell is made of pliable material; and the window panel is rigid.

3. The organizing purse of claim 1 wherein the organizing insert further comprises at least one mesh pocket mounted to at least one of the at least two organizing compartments.

4. The organizing purse of claim 1 wherein the organizing insert further comprises at least one zipper closure structured and located to open and close one of the organizing compartments.

5. The organizing purse of claim 1, wherein the outer shell comprises:

an outer shell back panel having a first edge, a second edge, a third edge and a fourth edge;

a first outer shell peripheral panel connected to the first edge of the outer shell back panel;

a second outer shell peripheral panel connected to the second edge of the outer shell back panel;

a third outer shell peripheral panel connected to the third edge of the outer shell back panel; and an outer shell flap connected to the fourth edge of the outer shell back panel.

6. The organizing purse of claim 5, wherein the first, second and third outer shell peripheral panels are connected to the rigid panel at respective edges thereof.

7. The organizing purse of claim 1 wherein the outer shell further comprises a glasses pocket shaped and sized to secure a pair of eyeglasses.

8. The organizing purse of claim 7 further comprising a handle connected to the outer shell, with the handle being structured to allow a user to carry the organizing purse, wherein:

the eyeglasses pocket is located so that it extends into the interior space; and the eyeglasses pocket is located on the top side of the organizing purse when the organizing purse is carried by the handle.

9. A purse comprising:

an outer shell made of pliable material, with the outer shell defining an interior space and having a top opening, an interior space opening and an elongated-object holder opening;

at least one inner shell made of pliable material detachably mounted and located to define a main compartment within the interior space and to define a main compartment opening aligned with the interior space opening on the outer shell; and at least one elongated-object-holder shell made of pliable material and located within said inner shell to define an elongated-object-holder compartment shaped to hold elongated objects within the interior space and to define an elongated-object-holder opening aligned with said elongated-object holder opening in the outer shell.

10. The purse according to claim 9 wherein the elongated-object-holder compartment is shaped to tightly secure a folded umbrella.

11. The purse according to claim 9 wherein the elongated-object-holder compartment is shaped to tightly secure an elongated drinking bottle.

12. The purse according to claim 9 wherein the elongated-object-holder shell is generally tubular in shape.

13. The purse according to claim 9 wherein:

the outer shell comprises a first face and a second face;

the interior space opening is on the first face; and the elongated-object-holder opening is on the second face.

14. The purse according to claim 13 wherein the interior space main compartment opening and the elongated-object-holder opening are approximately perpendicular to each other.

15. The purse according to claim 9 wherein:

the elongated-object-holder further defines an elongated-object-holder depth;

the widest portion of the elongated-object-holder opening defines an elongated-object-holder width; and the elongated-object holder depth is more than five times as large as the elongated-object-holder width.

16. The purse according to claims 9 in combination with at least a second bag wherein:

the second bag is adapted to accommodate the organizer insert, with the second bag having a different size and shape than the purse; and wherein:

the organizer insert comprises at least one first attachment strip;

the purse comprises at least one second attachment strip, which is structured and located to be detachably attachable to the at least one first attachment strip; and the second bag comprises at least one third strip, which is structured and located to be detachably attachable to the at least one first attachment strip.

* * * * *